US011113962B2

(12) United States Patent
Kitajima et al.

(10) Patent No.: US 11,113,962 B2
(45) Date of Patent: Sep. 7, 2021

(54) TERMINAL DEVICE, REARWARD SERVER, IN-VEHICLE TRANSPONDER, DETERMINATION SYSTEM, DETERMINATION METHOD, AND PROGRAM

(71) Applicant: MITSUBISHI HEAVY INDUSTRIES MACHINERY SYSTEMS, LTD., Kobe (JP)

(72) Inventors: Kazuyoshi Kitajima, Kobe (JP); Tatsuya Higuchi, Tokyo (JP)

(73) Assignee: MITSUBISHI HEAVY INDUSTRIES MACHINERY SYSTEMS, LTD., Kobe (JP)

( * ) Notice: Subject to any disclaimer, the term of this patent is extended or adjusted under 35 U.S.C. 154(b) by 0 days.

(21) Appl. No.: 17/255,226

(22) PCT Filed: Jun. 27, 2018

(86) PCT No.: PCT/JP2018/024331
§ 371 (c)(1),
(2) Date: Dec. 22, 2020

(87) PCT Pub. No.: WO2020/003397
PCT Pub. Date: Jan. 2, 2020

(65) Prior Publication Data
US 2021/0118292 A1 Apr. 22, 2021

(51) Int. Cl.
*G08G 1/056* (2006.01)

(52) U.S. Cl.
CPC ..... *G08G 1/056* (2013.01)

(58) Field of Classification Search
None
See application file for complete search history.

(56) References Cited

U.S. PATENT DOCUMENTS

2003/0115095 A1 6/2003 Yamauchi
2010/0088163 A1* 4/2010 Davidson ..... G07C 5/02 340/425.5

(Continued)

FOREIGN PATENT DOCUMENTS

JP 2003-187281 A 7/2003
JP 2014-115931 A 6/2014
WO 2017/149655 A1 9/2017

OTHER PUBLICATIONS

PCT/ISA/210, "International Search Report for International Application No. PCT/JP2018/024331," dated Sep. 4, 2018.

(Continued)

*Primary Examiner* — John F Mortell
(74) *Attorney, Agent, or Firm* — Manabu Kanesaka; Benjamin Hauptman; Kenneth Berner

(57) ABSTRACT

A terminal device includes: a candidate acquiring unit configured to acquire reverse traveling candidate information including positional information and traveling direction information of a vehicle when a candidate determining unit configured to determine whether there is a likelihood that the vehicle is traveling in reverse determines that there is a likelihood that the vehicle is traveling in reverse; and a candidate transmitting unit configured to transmit the reverse traveling candidate information to a rearward server configured to determine whether the vehicle is traveling in reverse based on the reverse traveling candidate information.

11 Claims, 6 Drawing Sheets

(56) References Cited

U.S. PATENT DOCUMENTS

| | | | | |
|---|---|---|---|---|
| 2010/0153002 | A1* | 6/2010 | Lee | G08G 1/087 701/533 |
| 2017/0028902 | A1* | 2/2017 | Diaz | B60Q 1/22 |
| 2017/0203769 | A1* | 7/2017 | Ohta | B60W 50/12 |
| 2018/0050685 | A1* | 2/2018 | Atluri | B60K 6/40 |
| 2019/0031207 | A1 | 1/2019 | Nakamura | |

OTHER PUBLICATIONS

PCT/ISA/237, "Written Opinion of the International Searching Authority for International Application No. PCT/JP2018/024331," dated Sep. 4, 2018.

* cited by examiner

*1 REVERSE TRAVELING CANDIDATE INFORMATION (EXAMPLE)

| SERIAL No. | ON-BOARD UNIT ID | POSITIONAL INFORMATION | TRAVELING DIRECTION | DATE INFORMATION | TIME INFORMATION |
|---|---|---|---|---|---|
| 1 | 2018000010 | NORTH LATITUDE 36° 0' 0" EAST LONGITUDE 136° 30' 0" | NORTH-NORTH-WEST | 2018/5/25 | 11:30:36 |
| 2 | 2018000032 | NORTH LATITUDE 35° 35' 35" EAST LONGITUDE 139° 35' 50" | WEST-SOUTH-WEST | 2018/5/25 | 11:50:15 |
| 3 | | | | | |

FIG. 5

*2 REVERSE TRAVELING DETERMINATION TABLE (EXAMPLE)

| No | NORTH LATITUDE | EAST LONGITUDE | TRAVELING DIRECTION ≪DETERMINATION OF REVERSE TRAVELING≫ | TRAVELING DIRECTION ≪DETERMINATION OF CAUTION≫ | TRAVELING DIRECTION ≪DETERMINATION OF NO NOTIFICATION≫ |
|---|---|---|---|---|---|
| 1 | 34° 99' 45" - 35° 0' 80" | 136° 29' 50" - 136° 29' 90" | NORTH-WEST - NORTH-EAST | WEST - NORTH-WEST OR EAST - NORTH-EAST | OTHER THAN DESCRIBED DIRECTIONS |
| 2 | 36° 23' 30" - 36° 23' 40" | 136° 32' 20" - 136° 32' 25" | SOUTH-WEST - SOUTH-EAST | WEST - SOUTH-WEST OR EAST - SOUTH-EAST | OTHER THAN DESCRIBED DIRECTIONS |
| 3 | | | | | |

FIG. 6

*3 DETERMINATION RESULT INFORMATION (EXAMPLE)

| SERIAL No. | ON-BOARD UNIT ID | DATE INFORMATION | TIME INFORMATION | DETERMINATION RESULT |
|---|---|---|---|---|
| 1 | 2018000010 | 2018/5/25 | 11:30:36 | DETERMINATION OF REVERSE TRAVELING |
| 2 | 2018000032 | 2018/5/25 | 11:50:15 | DETERMINATION OF CAUTION |

TERMINAL DEVICE, REARWARD SERVER, IN-VEHICLE TRANSPONDER, DETERMINATION SYSTEM, DETERMINATION METHOD, AND PROGRAM

RELATED APPLICATIONS

The present application is National Phase of International Application No. PCT/JP2018/024331 filed Jun. 27, 2018, the disclosure of which is hereby incorporated by reference herein in its entirety.

TECHNICAL FIELD

The present invention relates to a terminal device, a rearward server, an in-vehicle transponder, a determination system, a determination method, and a program.

BACKGROUND ART

Recently, techniques of allowing a user of a vehicle to perform processes on the vehicle or to receive information on the vehicle using a terminal device such as a mobile phone have been developed. For example, Patent Document 1 discloses a technique of allowing a mobile phone owned by a user of a vehicle to communicate with a server connected to a system of a mobile phone company via a dedicated gate which is provided on a toll road such as an expressway and collecting a charge for the toll road from the user via the mobile phone company.

CITATION LIST

Patent Literature

[Patent Document 1]

Japanese Unexamined Patent Application, First Publication No. 2003-187281

SUMMARY OF INVENTION

Technical Problem

In the technique disclosed in Patent Document 1, communication associated with charges is performed, but communication associated with a traveling state of a vehicle is not performed. Accordingly, for example, even when a vehicle is traveling in reverse in a lane, it is not possible to determine whether the vehicle is traveling in reverse with the technique disclosed in Patent Document 1.

An objective of the invention is to provide a terminal device, a rearward server, an in-vehicle transponder, a determination system, a determination method, and a program that can enable determination of whether a vehicle is traveling in reverse.

Solution to Problem

A first aspect of the invention provides a terminal device (20, 20') including: a candidate acquiring unit (206) configured to acquire reverse traveling candidate information including positional information and traveling direction information of a vehicle (2) when a candidate determining unit (107) configured to determine whether there is a likelihood that the vehicle is traveling in reverse determines that there is a likelihood that the vehicle is traveling in reverse; and a candidate transmitting unit (207) configured to transmit the reverse traveling candidate information to a rearward server (3) configured to determine whether the vehicle is traveling in reverse based on the reverse traveling candidate information.

According to this aspect, the terminal device transmits the reverse traveling candidate information to the rearward server that determines whether the vehicle is traveling in reverse. Accordingly, the terminal device enables the rearward server to determine whether the vehicle is traveling in reverse.

A second aspect of the invention provides the terminal device according to the first aspect, wherein the candidate acquiring unit is configured to acquire the reverse traveling candidate information from an in-vehicle transponder (10, 10') of the vehicle.

According to this aspect, the terminal device acquires the reverse traveling candidate information from the in-vehicle transponder. Accordingly, the terminal device can easily acquire effective reverse traveling candidate information.

A third aspect of the invention provides the terminal device according to the first or second aspect further including: a determination receiving unit (208) configured to receive reverse traveling determination information indicating that the vehicle is traveling in reverse from the rearward server; and an alarm unit (209) configured to output an alarm when the reverse traveling determination information is received.

According to this aspect, the terminal device can output an alarm at the time of reverse travel. Accordingly, the terminal device can call a user's attention.

A fourth aspect of the invention provides a rearward server including: a candidate receiving unit (305) configured to receive reverse traveling candidate information including positional information and traveling direction information of a vehicle from a terminal device when a candidate determining unit configured to determine whether there is a likelihood that the vehicle is traveling in reverse determines that there is a likelihood that the vehicle is traveling in reverse; a reverse traveling determining unit (306) configured to determine whether the vehicle is traveling in reverse based on the reverse traveling candidate information; and a determination transmitting unit (307) configured to transmit reverse traveling determination information indicating that the vehicle is traveling in reverse when a determination that the vehicle is traveling in reverse is performed.

According to this aspect, the rearward server determines whether the vehicle is traveling in reverse based on the reverse traveling candidate information. Accordingly, even when an application for determining whether the vehicle is traveling in reverse is updated, an application of the rearward server has only to be updated and thus it is possible to reduce a load of an application updating operation.

A fifth aspect of the invention provides the rearward server according to the fourth aspect, wherein the reverse traveling determining unit is configured to determine that the vehicle is traveling in reverse when the positional information and the traveling direction information are within a prescribed range.

According to this aspect, the rearward server determines the positional information and the traveling direction information of the reverse traveling candidate information. Accordingly, even when a range for determining the positional information and the traveling direction information is updated, an application of the rearward server has only to be updated and thus it is possible to reduce a load of an application updating operation.

A sixth aspect of the invention provides an in-vehicle transponder including: a candidate determining unit configured to determine whether there is a likelihood that a vehicle is traveling in reverse; and a candidate transmitting unit (108) configured to transmit reverse traveling candidate information to a terminal device configured to transmit the reverse traveling candidate information to a rearward server configured to determine whether the vehicle is traveling in reverse based on the reverse traveling candidate information including positional information and traveling direction information of the vehicle when the candidate determining unit determines that there is a likelihood that the vehicle is traveling in reverse.

According to this aspect, the in-vehicle transponder determines the reverse traveling candidate information and transmits the reverse traveling candidate information to a terminal device that transmits the reverse traveling candidate information to the rearward server. Accordingly, the in-vehicle transponder enables determination of whether the vehicle is traveling in reverse.

A seventh aspect of the invention provides a determination system including: a candidate determining unit configured to determine whether there is a likelihood that a vehicle is traveling in reverse; a candidate transmitting unit configured to transmit reverse traveling candidate information including positional information and traveling direction information of the vehicle when the candidate determining unit determines that there is a likelihood that the vehicle is traveling in reverse; a reverse traveling determining unit configured to determine whether the vehicle is traveling in reverse based on the reverse traveling candidate information; and a determination transmitting unit configured to transmit reverse traveling determination information indicating that the vehicle is traveling in reverse when a determination that the vehicle is traveling in reverse is performed.

According to this aspect, the determination system determines whether the vehicle is traveling in reverse based on the reverse traveling candidate information. Accordingly, the determination system enables determination of whether the vehicle is traveling in reverse.

An eighth aspect of the invention provides a determination method including: a step of determining whether there is a likelihood that a vehicle is traveling in reverse; a step of transmitting reverse traveling candidate information including positional information and traveling direction information of the vehicle when a determination that there is a likelihood that the vehicle is traveling in reverse is performed; a step of determining whether the vehicle is traveling in reverse based on the reverse traveling candidate information; and a step of transmitting reverse traveling determination information indicating that the vehicle is traveling in reverse when a determination that the vehicle is traveling in reverse is performed.

According to this aspect, the determination method includes determining whether the vehicle is traveling in reverse based on the reverse traveling candidate information. Accordingly, the determination method enables determination of whether the vehicle is traveling in reverse.

A ninth aspect of the invention provides a program causing a computer of a terminal device to perform: a step of acquiring reverse traveling candidate information including positional information and traveling direction information of a vehicle when a determination that there is a likelihood that the vehicle is traveling in reverse is performed; and a step of transmitting the reverse traveling candidate information to a rearward server configured to determine whether the vehicle is traveling in reverse based on the reverse traveling candidate information.

According to this aspect, the program can cause the terminal device to transmit the reverse traveling candidate information to the rearward server that determines whether the vehicle is traveling in reverse. Accordingly, the program enables determination of whether the vehicle is traveling in reverse.

Advantageous Effects of Invention

According to the aforementioned aspects, it is possible to determine whether a vehicle is traveling in reverse.

BRIEF DESCRIPTION OF DRAWINGS

FIG. 5 is a table showing an example of a reverse traveling determination table according to the first embodiment.

FIG. 6 is a table showing an example of determination result information according to the first embodiment.

DESCRIPTION OF EMBODIMENTS

Figure 1:
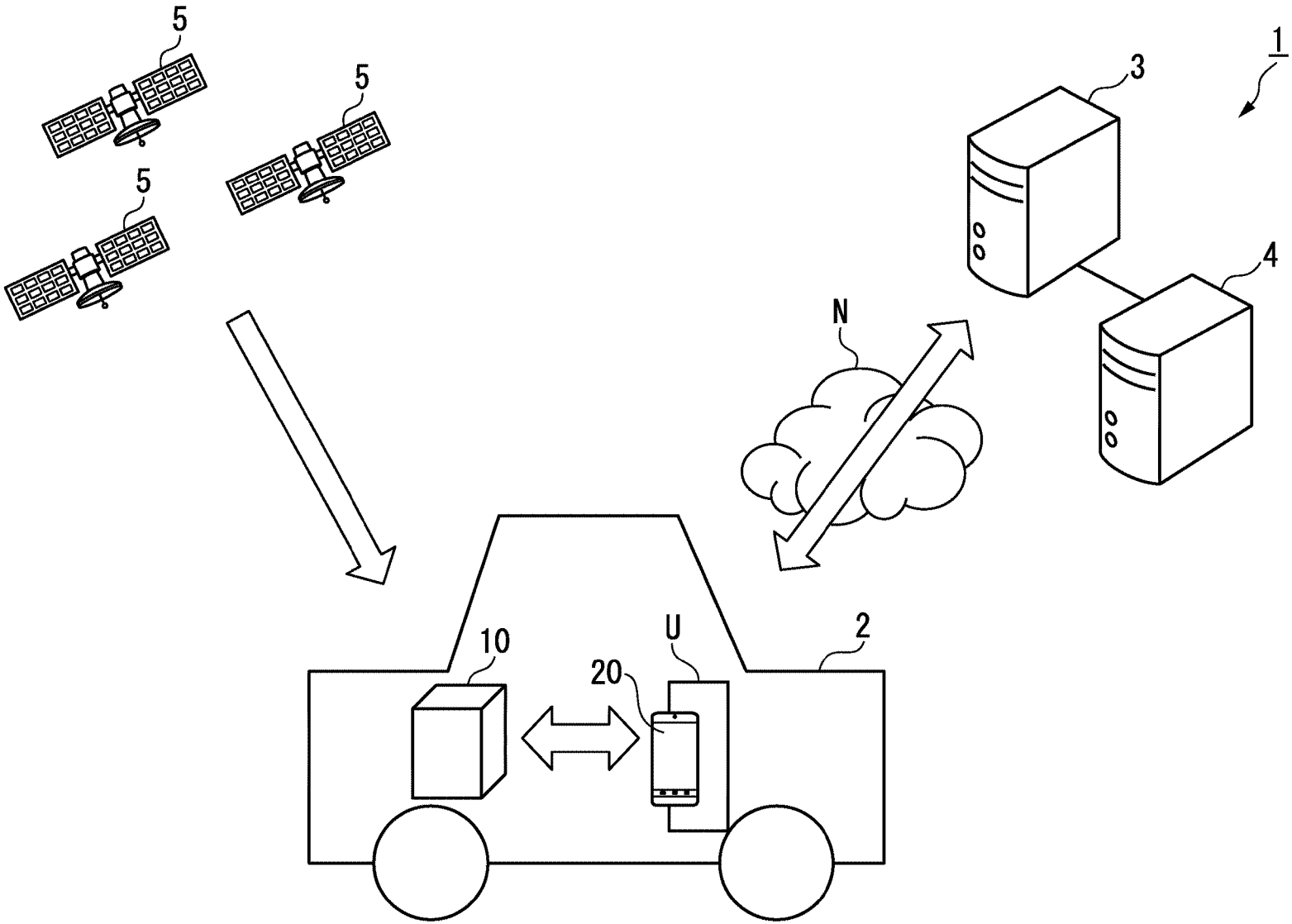
FIG. 1 is a diagram schematically showing a whole configuration of a determination system according to a first embodiment.

Hereinafter, embodiments of the present invention will be described with reference to the accompanying drawings. The same or corresponding elements in the drawings will be referred to by the same reference signs and description thereof will not be repeated.

First Embodiment

A first embodiment will be described below with reference to the drawings.

(Whole Configuration of Determination System)

The whole configuration of a determination system 1 according to the first embodiment will be described below with reference to FIG. 1.

As shown in FIG. 1, the determination system 1 includes an in-vehicle transponder 10 that is mounted in a vehicle 2, a terminal device 20 that is owned by a user U who uses the vehicle 2, and a service system management server (rearward server) 3.

The determination system 1 according to the first embodiment may further include a payment account management server 4.

In the first embodiment, the expression "a user U uses a vehicle 2" means that "the user U boards and drives the vehicle 2," but the expression "a user U uses a vehicle 2"

refers to all situations in which the user U uses the vehicle 2 such as a situation in which "the user U is provided with a service of a vehicle allocation application system of the vehicle 2 according to the vehicle allocation application system," a situation in which "the user U is provided with a car rental service of the vehicle 2 which is a rented car," and a situation in which "the user U is provided with an automated driving service of a vehicle 2 which is an automated driving vehicle. In the first embodiment, the expression "a user U" refers to a human being, but a "user U" may refer to, for example, an "automated driving device" instead of a "human being."

The service system management server 3 is a management server that manages a service system that provides a specific service to a user U who uses a vehicle 2. The payment account management server 4 is connected to the service system management server 3 and is a management server that manages a payment account of a user U. For the purpose of simplification of explanation, only one service system management server 3 is shown in FIG. 1, but a plurality of service system management servers 3 for other service systems that provide other services may be provided.

In the first embodiment, an in-vehicle transponder 10 that is mounted in a vehicle 2 may be configured to receive radio waves from a plurality of satellites 5 of a global navigation satellite system (GNSS) and to calculate and determine a position of the vehicle 2. The in-vehicle transponder 10 is integrated with the vehicle 2 and is configured such that detachment and reinstallation are not possible.

For example, the in-vehicle transponder 10 may be fixed by a fixture such as a Kensington wire such that it cannot be physically detached from the vehicle 2.

For example, the in-vehicle transponder 10 may have a software fixing function based on a tamper-proof function for identifying a vehicle in which it is mounted.

For example, the in-vehicle transponder 10 may be authenticated using radio frequency identification (RFID) and be configured to detect detachment from the vehicle 2 in software by a tamper-proof function of the RFID technology or the like.

For example, the in-vehicle transponder 10 may be configured to prevent copying, changing, or the like of an identification ID or copying, changing, or the like of vehicle data by a security function.

The terminal device 20 is an intelligent terminal such as a smartphone, a mobile phone, a PDA terminal, or another communicative mobile electronic device which is owned by the user U of the vehicle 2 and may perform execution, storage, and calculation of a program such that an application can be installed and started. In the first embodiment, it is assumed that the terminal device 20 is a smartphone. The terminal device 20 may include a user interface based on functions of display of light, an image, a mark, and the like, recognition of voice, outputting of sound, and the like. The terminal device 20 is configured to communicate with the in-vehicle transponder 10 mounted in the vehicle 2. The terminal device 20 is configured to communicate with the service system management server 3 via a communication network N such as a 3G network, a 4G network, or an LTE network.

In the first embodiment, it is assumed that the service system management server 3 is an integrated system server of ETC (registered trademark) that manages a service system of an expressway that provides services of the expressway such as payment of a charge for the expressway. However, the service system management server 3 may be a service system management server that manages a service system for something other than an expressway. For example, the service system management server 3 may be an integrated system server in a parking lot, an integrated system server of electronic road pricing (ERP) (also referred to as "electronic road charging"), an integrated system server of a vehicle allocation application system, or an integrated system server of an automated driving vehicle.

The service system management server 3 is configured to communicate with the terminal device 20 which is owned by the user U of the vehicle 2 and to receive charging information in which a charge associated with the vehicle 2 which is used by the user U for a predetermined service is correlated with a payment account ID which is stored in advance in the terminal device 20 from the terminal device 20. In the first embodiment, it is assumed that the predetermined service is a service of an expressway and the charge associated with the vehicle 2 which is used by the user U is a toll of the expressway, but the charge may be, for example, a charge for a parking lot, a charge for ERP, a charge for a vehicle allocation application system, or a charge for an automated driving vehicle depending on a service which is used. The service system management server 3 is configured to transmit the received charging information to the payment account management server 4.

When the charging information of the user U is received from the service system management server 3, the payment account management server 4 is configured to transmit the charging information to a system (not shown) of a financial institution such as a bank or a credit card company with which the user U has made a contract. Accordingly, the system of the financial institution performs a charge payment process associated with the vehicle 2 which is used by the user U for a predetermined service. The payment account management server 4 is configured to transmit an account statement of a charge associated with the vehicle 2 which is used by the user U after transmitting the charging information to the system of the financial institution.

(Functional Configuration of Determination System)

Figure 2:
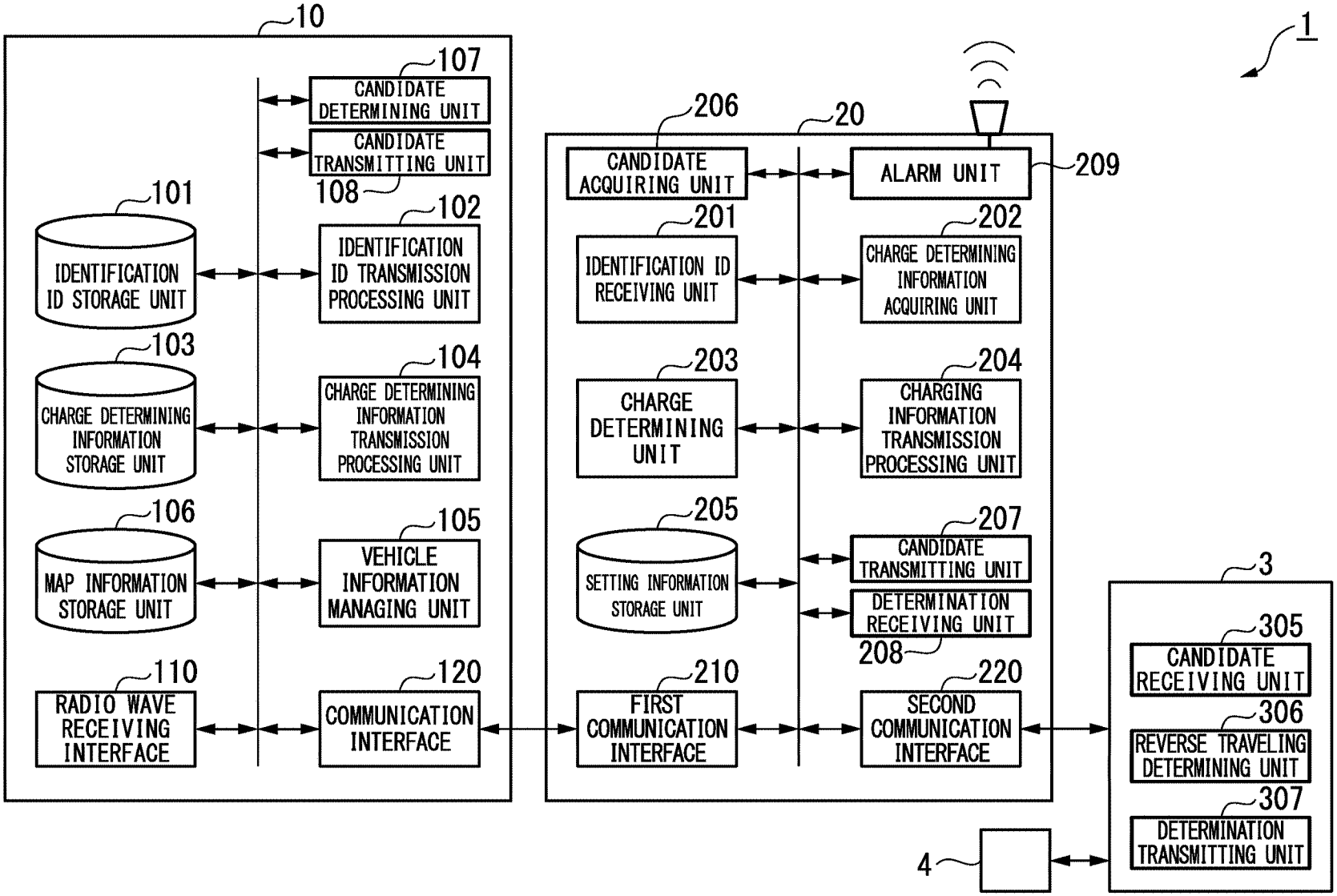
FIG. 2 is a block diagram showing a functional configuration of the determination system according to the first embodiment.

The functional configurations of the in-vehicle transponder 10, the terminal device 20, and the service system management server 3 which are provided in the determination system 1 will be described below with reference to FIG. 2.

(Functional Configuration of In-Vehicle Transponder)

The in-vehicle transponder 10 includes a candidate determining unit 107 and a candidate transmitting unit 108.

The in-vehicle transponder 10 may further include an identification ID storage unit 101, an identification ID transmission processing unit 102, a charge determining information storage unit 103, a charge determining information transmission processing unit 104, a vehicle information managing unit 105, a map information storage unit 106, a radio wave receiving interface 110, and a communication interface 120.

The identification ID storage unit 101 is configured to store an identification ID for uniquely identifying the in-vehicle transponder 10 mounted in the vehicle 2. For example, the identification ID may be a unique character string including at least one of numerals, English letters, signs, and the like which are uniquely given to the in-vehicle transponder 10 in one-to-one correspondence with the manufacturing number of the vehicle 2 in which the in-vehicle transponder 10 is mounted. Accordingly, the vehicle 2 in which the in-vehicle transponder 10 is mounted can be identified on the basis of the identification ID of the in-vehicle transponder 10. Information indicating the correlation between the in-vehicle transponder 10 and the manufacturing number of the vehicle 2 may be stored by a specific institution such as a manufacturing company of the in-vehicle transponder 10.

The identification ID transmission processing unit 102 is configured to acquire the identification ID stored in the identification ID storage unit 101 and to perform a transmission process of transmitting the acquired identification ID to the terminal device 20 which is owned by the user U of the vehicle 2 via the communication interface 120.

The charge determining information storage unit 103 is configured to store charge determining information for determining a charge associated with the vehicle 2. In the first embodiment, it is assumed that the charge determining information includes a traveling route, a traveling distance, a vehicle model, number plate information, and vehicle information of the vehicle 2 which is used by the user U, but the charge determining information may be other information for determining a charge associated with the vehicle 2. The traveling route and the traveling distance of the vehicle 2 may be determined by the vehicle information managing unit 105 which will be described later and, for example, periodically stored in the charge determining information storage unit 103. The vehicle model, the number plate information, and the vehicle information of the vehicle 2 may be stored in advance, for example, in the charge determining information storage unit 103 before the in-vehicle transponder 10 is mounted in the vehicle 2. Here, vehicle information is vehicle data for identifying a weight, a size, a charge class, and the like of the vehicle 2 and is, for example, vehicle inspection information.

The charge determining information transmission processing unit 104 is configured to acquire charge determining information stored in the charge determining information storage unit 103 and to perform a transmission process of transmitting the acquired charge determining information to the terminal device 20 which is owned by the user U of the vehicle 2 via the communication interface 120 while the terminal device 20 and the in-vehicle transponder 10 are connected to each other. Specifically, in the first embodiment, the charge determining information transmission processing unit 104 is configured to start connection between the in-vehicle transponder 10 and the terminal device 20 and to perform acquisition of the charge determining information and transmission of the charge determining information to the terminal device 20 when the charge determining information transmission processing unit 104 receives an acknowledgement signal indicating that the identification ID of the in-vehicle transponder 10 has been received from an identification ID receiving unit 201 of the terminal device 20 via the communication interface 120. Thereafter, until the connection between the in-vehicle transponder 10 and the terminal device 20 is cut off, acquisition of the charge determining information and transmission of the charge determining information to the terminal device 20 may be periodically performed by the charge determining information transmission processing unit 104. Acquisition of the charge determining information and transmission of the charge determining information to the terminal device 20 may be irregularly performed by the charge determining information transmission processing unit 104.

The vehicle information managing unit 105 is configured to manage vehicle information of the vehicle 2.

The vehicle information managing unit 105 acquires information (positional information) indicating a current position of the vehicle 2.

For example, the vehicle information managing unit 105 may periodically calculate the current positional information of the vehicle 2 on the basis of information of radio waves from GNSS satellites 5 received via the radio wave receiving interface 110.

The vehicle information managing unit 105 acquires information (traveling direction information) indicating a traveling direction of the vehicle 2.

For example, the vehicle information managing unit 105 sequentially acquires the acquired positional information of the vehicle 2 and acquires the current traveling direction information of the vehicle 2 on the basis of a variation of the positional information of the vehicle 2 with time.

The vehicle information managing unit 105 may determine a current traveling route and a current traveling speed of the vehicle 2 on the basis of the change of the calculated positional information of the vehicle 2.

The vehicle information managing unit 105 may store the determined traveling route and the determined traveling speed of the vehicle 2 as charge determining information in the charge determining information storage unit 103.

The radio wave receiving interface 110 is configured to receive radio waves from the GNSS satellites 5.

The communication interface 120 is an interface that enables communication between the in-vehicle transponder 10 and the terminal device 20. In the first embodiment, for example, it is assumed that the communication interface 120 is configured to perform radio communication based on the standard of Bluetooth (registered trademark) between the in-vehicle transponder 10 and the terminal device 20, but radio communication based on other standards such as infrared communication and WiFi communication may be performed. For example, the communication interface 120 may be configured to perform wired communication between the in-vehicle transponder 10 and the terminal device 20.

The map information storage unit 106 is configured to store map information for identifying each of lanes and traveling direction of each of the lanes. In the first embodiment, map information for identifying each of lanes of each expressway and traveling direction of each of the lanes is stored.

The candidate determining unit 107 is configured to determine whether there is a likelihood that the vehicle 2 is traveling in reverse.

For example, first, the candidate determining unit 107 identifies a lane in which the vehicle 2 is traveling on the basis of the positional information of the vehicle 2 and the traveling direction information of the vehicle 2 which are acquired by the vehicle information managing unit 105 with reference to the map information. Subsequently, the candidate determining unit 107 identifies a traveling direction of the identified lane with reference to the map information. Subsequently, the candidate determining unit 107 determines whether there is a likelihood that the vehicle 2 is traveling in reverse by determining whether the traveling direction information of the vehicle 2 is opposite to the traveling direction.

When the candidate determining unit 107 determines that there is a likelihood that the vehicle 2 is traveling in reverse, the candidate transmitting unit 108 transmits reverse traveling candidate information including the positional information of the vehicle 2 and the traveling direction information of the vehicle 2 to the terminal device 20.

In the first embodiment, when the candidate determining unit 107 determines that there is a likelihood that the vehicle 2 is traveling in reverse, the candidate transmitting unit 108 transmits the reverse traveling candidate information to the terminal device 20.

(Functional Configuration of Terminal Device)

The terminal device 20 includes a candidate acquiring unit 206 and a candidate transmitting unit 207.

The terminal device 20 transmits reverse traveling candidate information to the service system management server 3.

The terminal device 20 may further include an identification ID receiving unit 201, a charge determining information acquiring unit 202, a charge determining unit 203, a charging information transmission processing unit 204, a setting information storage unit 205, a determination receiving unit 208, an alarm unit 209, a first communication interface 210, and a second communication interface 220.

In the first embodiment, an application cooperating with the service system management server 3 may be installed in the terminal device 20 which is a smartphone and this application may serve as the identification ID receiving unit 201, the charge determining information acquiring unit 202, the charge determining unit 203, the charging information transmission processing unit 204, the candidate acquiring unit 206, the candidate transmitting unit 207, the determination receiving unit 208, and the alarm unit 209. The identification ID receiving unit 201, the charge determining information acquiring unit 202, the charge determining unit 203, the charging information transmission processing unit 204, the candidate acquiring unit 206, the candidate transmitting unit 207, the determination receiving unit 208, and the alarm unit 209 may be originally provided in the terminal device 20 without being introduced as an application.

In the first embodiment, it is assumed that the application installed in the terminal device 20 is an application for providing a service of an expressway, but the application installed in the terminal device 20 may be another application corresponding to a specific service which is used by the user U. The application is started by allowing the user U to operate the terminal device 20 which is a smartphone and to input a start command of the application to the terminal device 20. Similarly, the service of the application is started by allowing the user U to input a service start command to the terminal device 20 and the service of the application is ended by allowing the user U to input a service end command.

The identification ID receiving unit 201 is configured to receive an identification ID which is transmitted from the in-vehicle transponder 10 mounted in the vehicle 2 which is used by the user U and received via the first communication interface 210. When the identification ID receiving unit 201 receives the identification ID, the in-vehicle transponder 10 mounted in the vehicle 2 which is used by the user U is identified and thus the vehicle 2 correlated with the in-vehicle transponder 10 in a one-to-one correspondence manner is identified. The identification ID receiving unit 201 is configured to transmit an acknowledgement signal indicating that the identification ID of the in-vehicle transponder 10 mounted in the vehicle 2 which is used by the user U has been received to the in-vehicle transponder 10 via the first communication interface 210.

The charge determining information acquiring unit 202 is configured to acquire charge determining information for determining a charge associated with the vehicle 2 while the terminal device 20 and the in-vehicle transponder 10 are connected to each other. In the first embodiment, the charge determining information acquiring unit 202 may acquire the charge determining information by receiving the charge determining information transmitted from the in-vehicle transponder 10 mounted in the vehicle 2 via the first communication interface 210. The charge determining information acquiring unit 202 is configured to input the acquired charge determining information to the charge determining unit 203. In the first embodiment, it is assumed that the charge determining information acquiring unit 202 periodically acquires the charge determining information which is periodically transmitted from the charge determining information transmission processing unit 104 of the in-vehicle transponder 10, but the charge determining information may be irregularly acquired by the charge determining information acquiring unit 202.

The charge determining unit 203 is configured to determine a charge of the vehicle 2 on the basis of the charge determining information acquired by the charge determining information acquiring unit 202. In the first embodiment, the charge determining unit 203 determines the charge of the vehicle 2 on the basis of the charge determining information at a time at which a service end command for the application is input to the terminal device 20 by the user U, but the charge determining unit 203 may determine the charge of the vehicle 2 at other times. For example, the charge determining information acquiring unit 202 may periodically acquire the charge determining information and the charge determining unit 203 may periodically determine the charge of the vehicle 2 at a time at which the charge determining information is input to the charge determining unit 203. The charge determining unit 203 is configured to input information of the determined charge to the charging information transmission processing unit 204.

When the information of the determined charge is input from the charge determining unit 203, the charging information transmission processing unit 204 is configured to acquire a payment account ID of the user U which is stored in advance in the setting information storage unit 205 and to transmit the information of the charge and the payment account ID to the service system management server 3 as charging information in correlation with each other.

The setting information storage unit 205 is configured to store the payment account ID of the user U who carries the terminal device 20. In the first embodiment, for example, when an application is installed in the terminal device 20, the payment account ID of the user U may be stored in the setting information storage unit 205 by allowing the user U to input the payment account ID to the terminal device 20.

The first communication interface 210 is an interface that enables communication between the in-vehicle transponder 10 and the terminal device 20. The first communication interface 210 is configured to perform communication based on the same standard as the communication interface 120 of the in-vehicle transponder 10. In the first embodiment, for example, radio communication based on the standard of Bluetooth (registered trademark) is performed between the in-vehicle transponder 10 and the terminal device 20, but radio communication based on other standards such as infrared communication and WiFi communication may be performed similarly to the communication interface 120. For example, the first communication interface 210 may be configured to perform wired communication between the in-vehicle transponder 10 and the terminal device 20.

The second communication interface 220 is an interface that enables communication between the terminal device 20 and the service system management server 3. In the first embodiment, the second communication interface 220 is configured to be connected to a communication network N such as a 3G network, a 4G network, and an LTE network and is configured to communicate with the service system management server 3 via the communication network N.

The candidate acquiring unit 206 is configured to acquire reverse traveling candidate information including the positional information of the vehicle 2 and the traveling direction information of the vehicle 2.

In the first embodiment, the candidate acquiring unit 206 acquires the reverse traveling candidate information from the in-vehicle transponder 10.

When there is a likelihood that the vehicle 2 is traveling in reverse, the candidate transmitting unit 207 transmits the reverse traveling candidate information including the positional information of the vehicle 2 and the traveling direction information of the vehicle 2 to the service system management server 3.

For example, when the candidate determining unit 107 determines that there is a likelihood that the vehicle 2 is traveling in reverse, the candidate transmitting unit 207 transmits the reverse traveling candidate information including the positional information of the vehicle 2 and the traveling direction information of the vehicle 2 to the service system management server 3.

In the first embodiment, when the candidate acquiring unit 206 acquires the reverse traveling candidate information from the in-vehicle transponder 10, the reverse traveling candidate information is transmitted to the service system management server 3.

The determination receiving unit 208 is configured to receive reverse traveling determination information indicating that the vehicle is traveling in reverse from the service system management server 3.

In the first embodiment, the determination receiving unit 208 receives determination result information including the reverse traveling determination information from the service system management server 3.

The alarm unit 209 outputs an alarm when the reverse traveling determination information is received.

In the first embodiment, when the determination receiving unit 208 receives the reverse traveling determination information from the service system management server 3, an alarm is output.

The alarm unit 209 outputs an alarm via a user interface of the terminal device 20. For example, the user interface generates sound, display, light emission, vibration, or the like as outputting of the alarm.

(Function Configuration of Rearward Server)

The service system management server 3 includes a candidate receiving unit 305, a reverse traveling determining unit 306, and a determination transmitting unit 307.

The service system management server 3 determines whether the vehicle 2 is traveling in reverse on the basis of the reverse traveling candidate information including the positional information and the traveling direction information of the vehicle 2.

When there is a likelihood that the vehicle 2 is traveling in reverse, the candidate receiving unit 305 receives the reverse traveling candidate information including the positional information of the vehicle 2 and the traveling direction information of the vehicle 2 from the terminal device 20.

For example, when the candidate determining unit 107 determines that there is a likelihood that the vehicle 2 is traveling in reverse, the candidate receiving unit 305 receives the reverse traveling candidate information including the positional information of the vehicle 2 and the traveling direction information of the vehicle 2 from the terminal device 20.

In the first embodiment, the candidate receiving unit 305 receives the reverse traveling candidate information from the candidate transmitting unit 207.

The reverse traveling determining unit 306 determines whether the vehicle 2 is traveling in reverse on the basis of the reverse traveling candidate information including the positional information of the vehicle 2 and the traveling direction information of the vehicle 2.

In the first embodiment, the reverse traveling determining unit 306 determines whether the vehicle 2 is traveling in reverse on the basis of the reverse traveling candidate information of the vehicle 2 received by the candidate receiving unit 305.

When the positional information of the vehicle 2 and the traveling direction information of the vehicle 2 are within prescribed ranges, the reverse traveling determining unit 306 determines that the vehicle 2 is traveling in reverse.

For example, an area in which reverse traveling is likely to occur such as an area in the vicinity of an interchange or an area in the vicinity of a parking lot is defined as the prescribed range for the positional information of the vehicle 2.

For example, a range centering on a direction opposite to the traveling direction of a lane associated with the positional information of the vehicle 2 is defined as the prescribed range for the traveling direction information of the vehicle 2.

When the determination that the vehicle 2 is traveling in reverse is performed, the determination transmitting unit 307 is configured to transmit reverse traveling determination information indicating that the vehicle is traveling in reverse.

In the first embodiment, when the reverse traveling determining unit 306 determines that the vehicle is traveling in reverse, the determination transmitting unit 307 transmits determination result information including the reverse traveling determination information to the determination receiving unit 208.

(Determination Method)

A determination method using the determination system 1 will be described below with reference to FIG. 3.

First, the positional information of the vehicle 2 and the traveling direction information of the vehicle 2 are acquired (Step ST01).

In the first embodiment, (the vehicle information managing unit 105 of) the in-vehicle transponder 10 acquires the positional information of the vehicle 2 and the traveling direction information of the vehicle 2.

Subsequently to Step ST01, a determination whether there is a likelihood that the vehicle 2 is traveling in reverse is performed (Step ST02).

In the first embodiment, (the candidate determining unit 107 of) the in-vehicle transponder 10 determines whether there is a likelihood that the vehicle 2 is traveling in reverse.

When the determination that there is no likelihood that the vehicle 2 is traveling in reverse is performed (Step ST02: NO), Step ST01 is performed again.

When the determination that there is a likelihood that the vehicle 2 is traveling in reverse is performed (Step ST02: YES), the reverse traveling candidate information including the positional information of the vehicle 2 and the traveling direction information of the vehicle 2 is transmitted (Step ST03).

In the first embodiment, (the candidate transmitting unit 207 of) the terminal device 20 transmits the reverse traveling candidate information including the positional information of the vehicle 2 and the traveling direction information of the vehicle 2 to (the candidate receiving unit 305 of) the service system management server 3.

Figures 3, 4:
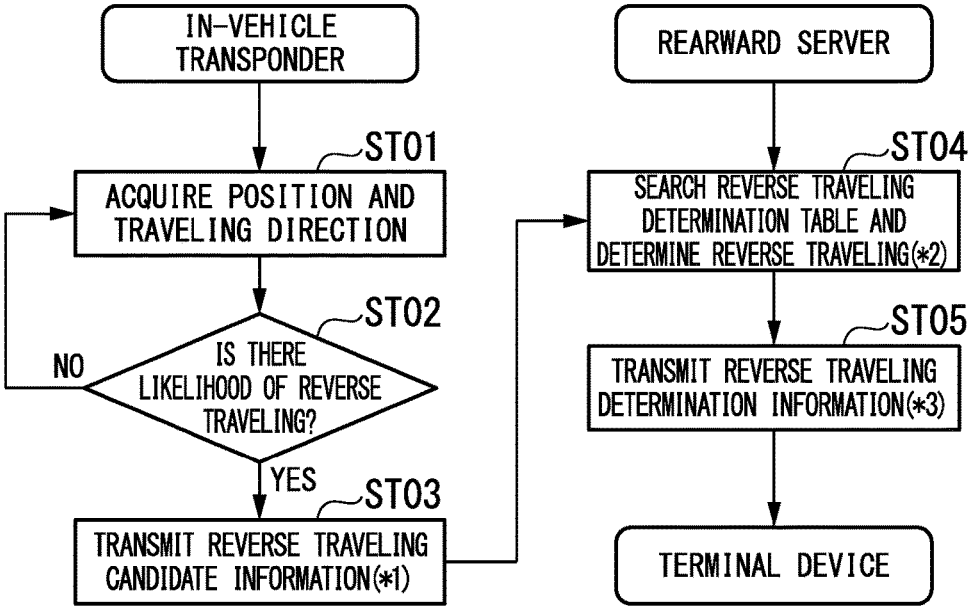
FIG. 3 is a flowchart showing a determination method according to the first embodiment.
FIG. 4 is a table showing an example of reverse traveling candidate information according to the first embodiment.

An example of the reverse traveling candidate information which is transmitted is shown in FIG. 4.

Subsequently to Step ST03, a determination whether the vehicle 2 is traveling in reverse on the basis of the reverse traveling candidate information is performed (Step ST04).

In the first embodiment, (the reverse traveling determining unit 306 of) the service system management server 3 determines whether the vehicle 2 is traveling in reverse on the basis of the reverse traveling candidate information.

An example of a reverse traveling determination table for determining whether the vehicle 2 is traveling in reverse on the basis of the reverse traveling candidate information is shown in FIG. 5.

The reverse traveling determining unit 306 determines that the vehicle 2 is traveling in reverse when the positional information and the traveling direction information are within prescribed ranges. The reverse traveling determining unit 306 searches for ranges associated with the reverse traveling candidate information in a plurality of ranges (No. 1, No. 2. No. 3 . . . ) defined in the reverse traveling determination table and determines whether the vehicle is traveling in reverse with the searched-for ranges as the prescribed ranges.

For example, in Step ST04, first, the reverse traveling determining unit 306 searches for a range in which the latitude and longitude of the positional information of the reverse traveling candidate information is included in the plurality of ranges (No. 1, No. 2, No. 3, . . . ) defined in the reverse traveling determination table. Subsequently, the reverse traveling determining unit 306 determines to which of a range of "determination of reverse traveling in traveling direction," a range of "determination of caution in traveling direction," and a range of "determination of no notification" defined in the searched range the traveling direction information of the reverse traveling candidate information belongs. Subsequently, when the traveling direction information of the reverse traveling candidate information is in the range of "determination of reverse traveling in traveling direction," the reverse traveling determining unit 306 determines that the vehicle is traveling in reverse. The reverse traveling determining unit 306 may determine "caution" when the traveling direction information of the reverse traveling candidate information is in the range of "determination of caution in traveling direction."

Subsequently to Step ST04, when the determination that the vehicle is traveling in reverse is performed, reverse traveling determination information indicating that the vehicle is traveling in reverse is transmitted (Step ST05).

In the first embodiment, when the determination that the vehicle is traveling in reverse is performed. (the determination transmitting unit 307 of) the service system management server 3 transmits determination result information including the reverse traveling determination information to (the determination receiving unit 208 of) the terminal device 20.

When the reverse traveling determining unit 306 determines "caution," the determination of caution may be transmitted to (the determination receiving unit 208 of) the terminal device 20. The terminal device 20 may receive the determination of caution and output an alarm. At this time, the terminal device 20 may output an alarm by sound, display, light emission, or vibration which is different from those when the reverse traveling determination information is received.

An example of the determination result information which is transmitted by the determination transmitting unit 307 is shown in FIG. 6.

(Operations and Advantages)

As described above, in the first embodiment, the determination system 1 determines whether a vehicle 2 is traveling in reverse on the basis of reverse traveling candidate information including positional information and traveling direction information of the vehicle 2. Accordingly, it is possible to determine whether the vehicle 2 is traveling in reverse.

When a vehicle enters an expressway, a driver thereof may drive the vehicle in reverse without being aware that a traveling direction is wrong and thus cause a serious road accident.

In order to prevent this problem, a system that detects an in-reverse traveling vehicle and employs cameras or sensors as road-side equipment can be considered, but investment costs on an expressway operation side are increased when it is intended to introduce such a system into entrance points of all expressways.

As in the first embodiment, when a system mounted in a vehicle can detect such reverse traveling, it is possible to curb an increase in costs on the expressway operation side and to achieve a decrease in occurrence of serious road accidents.

That is, the determination system 1 can determine that the vehicle 2 is traveling in reverse, for example, without providing sensors or cameras on a road side.

In the first embodiment, the terminal device 20 transmits the reverse traveling candidate information to the rearward server that determines whether a vehicle 2 is traveling in reverse. Accordingly, the terminal device 20 can determine reverse traveling of the vehicle 2.

In the first embodiment, the terminal device 20 acquires the reverse traveling candidate information from the in-vehicle transponder 10. The in-vehicle transponder 10 is more specialized in accurately acquiring the positional information and the traveling direction information of the vehicle 2 than the terminal device 20. Accordingly, the terminal device 20 can easily acquire effective reverse traveling candidate information.

In the first embodiment, the terminal device 20 can output an alarm at the time of reverse travel. Accordingly, the terminal device 20 can alert a user's attention.

Since the terminal device 20 includes the alarm unit 209, the alarm can updated in the user interface which can be easily ascertained by the user U by updating the application of the terminal device 20. In general, the terminal device 20 can update an application more easily than the in-vehicle transponder 10. Accordingly, it is possible to reduce a load of an operation of updating an alarm in the user interface which can be easily ascertained by the user U.

In the first embodiment, the service system management server 3 determines whether the vehicle 2 is traveling in reverse on the basis of the reverse traveling candidate information. Accordingly, even when an application for determining whether the vehicle is traveling in reverse is updated, an application of the service system management server 3 has only to be updated and thus it is possible to reduce a load of an application updating operation.

In the first embodiment, the service system management server 3 determines the positional information and the traveling direction information of the reverse traveling candidate information. Accordingly, even when a range for determining the positional information and the traveling direction information is updated, an application of the service system management server 3 has only to be updated and thus it is possible to reduce a load of an application updating operation.

In the first embodiment, the in-vehicle transponder 10 determines the reverse traveling candidate information and transmits the reverse traveling candidate information to the terminal device 20 that transmits the reverse traveling candidate information to the service system management server 3. Accordingly, the in-vehicle transponder 10 enables determination of whether the vehicle 2 is traveling in reverse.

Second Embodiment

A first embodiment will be described below with reference to the drawings.

The second embodiment is different from the first embodiment in that the in-vehicle transponder includes a determination receiving unit 208 and an alarm unit 209.

Elements of a determination system 1' according to the second embodiment have the same configurations as the elements of the determination system 1 according to the first embodiment except those particularly mentioned and serve in the same way, and description thereof will not be repeated.

(Whole Configuration of Determination System)

The configuration of the determination system 1' according to the second embodiment will be described below with reference to FIG. 7.

Figure 7:
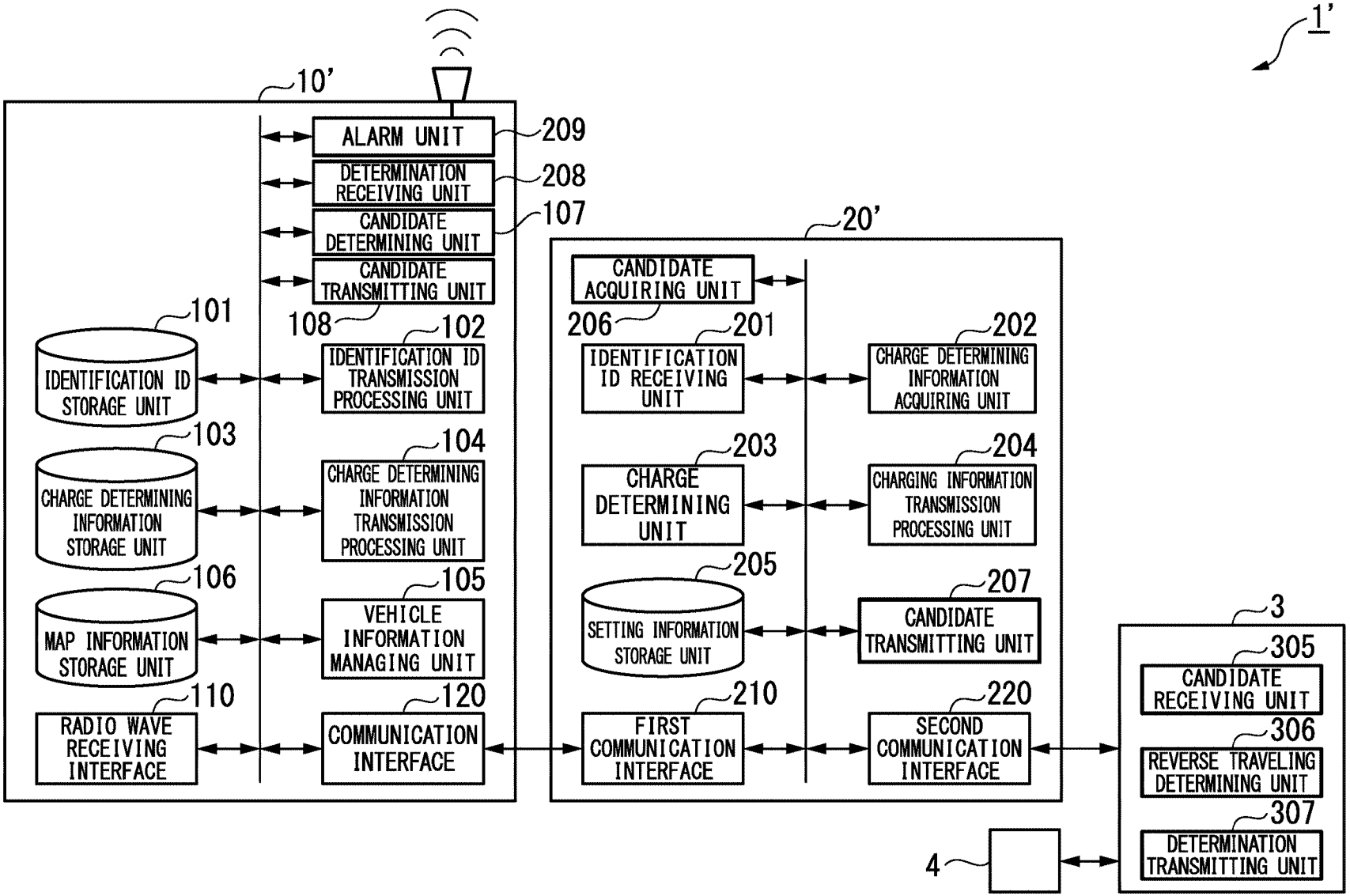
FIG. 7 is a block diagram showing a functional configuration of a determination system according to a second embodiment.

As shown in FIG. 7, the determination system 1' includes an in-vehicle transponder 10', a terminal device 20', and a service system management server 3.

The determination system 1' may further include a payment account management server 4.

(Functional Configuration)

The in-vehicle transponder 10' includes a candidate determining unit 107, a candidate transmitting unit 108, and a determination receiving unit 208.

The in-vehicle transponder 10' may further include an identification ID storage unit 101, an identification ID transmission processing unit 102, a charge determining information storage unit 103, a charge determining information transmission processing unit 104, a vehicle information managing unit 105, a map information storage unit 106, an alarm unit 209, a radio wave receiving interface 110, and a communication interface 120.

The terminal device 20' includes a candidate transmitting unit 207.

The terminal device 20' may further include an identification ID receiving unit 201, a charge determining information acquiring unit 202, a charge determining unit 203, a charging information transmission processing unit 204, a setting information storage unit 205, a candidate acquiring unit 206, a first communication interface 210, and a second communication interface 220.

(Determination Method)

Figure 8:
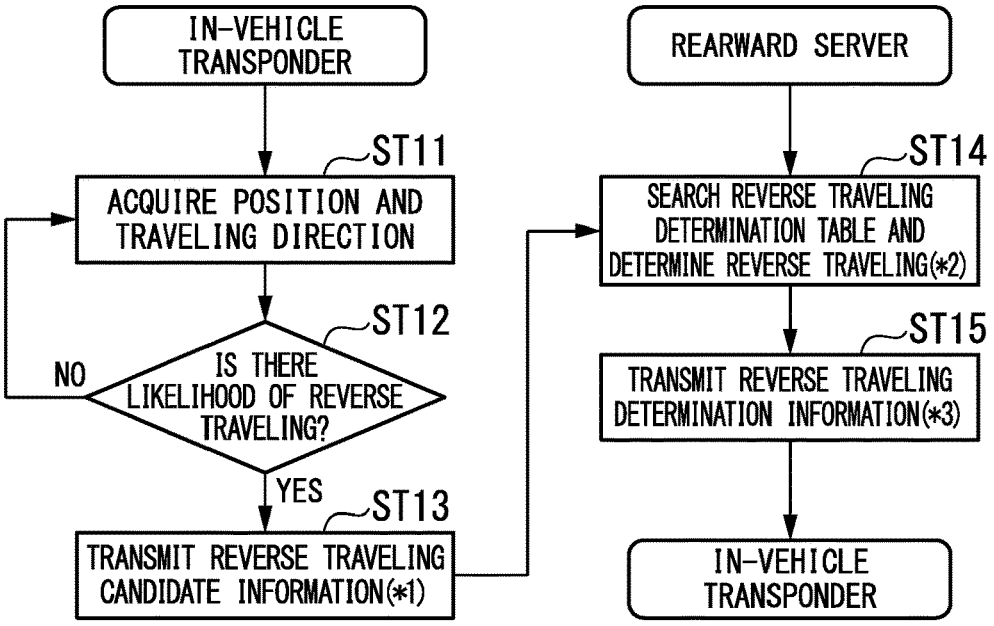
FIG. 8 is a flowchart showing a determination method according to the second embodiment.

A determination method using the determination system 1' will be described below with reference to FIG. 8.

The steps of the determination method using the determination system 1' according to the second embodiment are performed in the same way as the determination method using the determination system 1 according to the first embodiment except those particularly described and thus description thereof will not be repeated.

First, positional information of the vehicle 2 and traveling direction information of the vehicle 2 are acquired (Step ST11).

In the second embodiment, (the vehicle information managing unit 105 of) the in-vehicle transponder 10' acquires the positional information of the vehicle 2 and the traveling direction information of the vehicle 2.

Subsequently to Step ST11, a determination whether there is a likelihood that the vehicle 2 is traveling in reverse is performed (Step ST12).

In the second embodiment, (the candidate determining unit 107 of) the in-vehicle transponder 10' determines whether there is a likelihood that the vehicle 2 is traveling in reverse.

When the determination that there is no likelihood that the vehicle 2 is traveling in reverse is performed (Step ST12: NO), Step ST11 is performed again.

When the determination that there is a likelihood that the vehicle 2 is traveling in reverse is performed (Step ST12: YES), the reverse traveling candidate information including the positional information of the vehicle 2 and the traveling direction information of the vehicle 2 is transmitted (Step ST13).

In the second embodiment, (the candidate transmitting unit 207 of) the terminal device 20' transmits the reverse traveling candidate information including the positional information of the vehicle 2 and the traveling direction information of the vehicle 2 to (the candidate receiving unit 305 of) the service system management server 3.

An example of the reverse traveling candidate information which is transmitted is shown in FIG. 4.

Subsequently to Step ST13, a determination whether the vehicle 2 is traveling in reverse on the basis of the reverse traveling candidate information is performed (Step ST14).

In the second embodiment, (the reverse traveling determining unit 306 of) the service system management server 3 determines whether the vehicle 2 is traveling in reverse on the basis of the reverse traveling candidate information.

An example of a reverse traveling determination table for determining whether the vehicle 2 is traveling in reverse on the basis of the reverse traveling candidate information is shown in FIG. 5.

Subsequently to Step ST14, when the determination that the vehicle is traveling in reverse is performed, reverse traveling determination information indicating that the vehicle is traveling in reverse is transmitted (Step ST15).

In the second embodiment, when the determination that the vehicle is traveling in reverse is performed. (the determination transmitting unit 307 of) the service system management server 3 transmits determination result information including the reverse traveling determination information to (the determination receiving unit 208 of) the in-vehicle transponder 10'.

In this embodiment, the service system management server 3 transmits the determination result information to the in-vehicle transponder 10' via (the first communication interface 210 and the second communication interface 220 of) the terminal device 20'.

When the reverse traveling determining unit 306 determines "caution," the determination of caution may be transmitted to (the determination receiving unit 208 of) the in-vehicle transponder 10'. The in-vehicle transponder 10' may receive the determination of caution and output an alarm. At this time, the in-vehicle transponder 10' may output an alarm by sound, display, light emission, or vibration which is different from those when the reverse traveling determination information is received.

An example of the determination result information which is transmitted by the determination transmitting unit 307 is shown in FIG. 6.

(Operations and Advantages)

As described above, in the second embodiment, the determination system 1' determines whether a vehicle 2 is traveling in reverse on the basis of reverse traveling candidate information including positional information and traveling direction information of the vehicle 2. Accordingly, similarly to the first embodiment, it is possible to determine whether the vehicle 2 is traveling in reverse.

This embodiment is the same as the first embodiment in other points.

In the determination system 1', the in-vehicle transponder 10' can output an alarm at the time of reverse travel. Accordingly, the in-vehicle transponder 10' can call the user U's attention.

Modified Examples

In the aforementioned embodiments, the candidate acquiring unit 206 acquires positional information of a vehicle 2 and traveling direction information of the vehicle 2 from the in-vehicle transponder.

In a modified example, the candidate acquiring unit 206 may acquire the positional information of the vehicle 2 directly on the basis of radio waves from the GNSS satellites 5 without using the in-vehicle transponder.

That is, a radio wave receiving interface may be provided in the terminal device, and the candidate acquiring unit 206 may acquire the current position of the terminal device as the current positional information of the vehicle 2 on the basis of the radio waves from the GNSS satellites 5.

The candidate acquiring unit 206 may acquire the traveling direction information of the vehicle 2 on the basis of variation with time of the current position of the terminal device without using the in-vehicle transponder.

The determination systems according to the embodiments also serve as a charge determination system (or a charging system).

In a modified example, the determination system may not serve as a charge determination system (or a charging system).

For example, the in-vehicle transponder may not include the charge determining information storage unit 103 and the charge determining information transmission processing unit 104.

For example, the terminal device may not include the charge determining information acquiring unit 202, the charge determining unit 203, and the charging information transmission processing unit 204.

In the determination systems according to the embodiments, the service system management server 3 serves as a rearward server.

In a modified example, the payment account management server 4 may serve as a rearward server.

In another modified example, a server other than the service system management server 3 and the payment account management server 4 may serve as a rearward server.

In the aforementioned embodiments, various processes are performed by recording a program for realizing various functions of the terminal device on a computer-readable recording medium and causing a computer system such as a microcomputer to read the program recorded on the recording medium and to execute the read program. Here, various processes which are performed by a CPU of the computer system are stored in the form of a program in a computer-readable recording medium, and the processes are performed by causing a computer to read and execute the program. Examples of the computer-readable recording medium include a magnetic disk, a magneto-optical disc, a CD-ROM, a DVD-ROM, and a semiconductor memory. The computer program may be transmitted to a computer via a communication line and the computer having received the program may execute the program.

In the aforementioned embodiments, an example of a hardware configuration of a computer that executes a program for realizing various functions of the terminal device will be described below.

Figure 9:
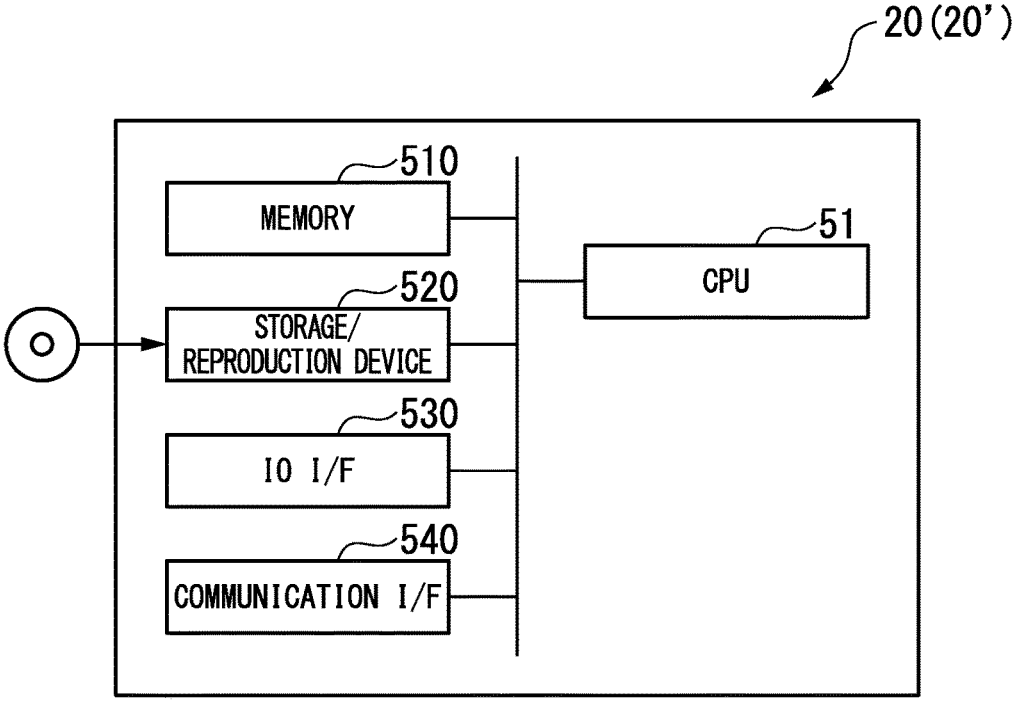
FIG. 9 is a diagram showing an example of a hardware configuration of a terminal device according to the first and second embodiments.

FIG. 9 is a diagram showing an example of a hardware configuration of a computer which is provided in the terminal device 20 (20').

As shown in FIG. 9, the computer provided in the terminal device 20 (20') includes a central processing unit (CPU) 51, a memory 510, a storage/reproduction device 520, an input output interface (IO I/F) 530, and a communication interface (I/F) 540.

The memory 510 is a medium such as a random access memory (RAM) that temporarily stores data used for a program which is executed by the terminal device 20 (20') and the like.

The storage/reproduction device 520 is a device that stores data and the like in an external medium such as a CD-ROM, a DVD, or a flash memory or reproduces data and the like of the external medium.

The IO I/F 530 is an interface that inputs and outputs information or the like between the terminal device 20 (20') and another device.

The communication I/F 540 is an interface that performs communication between the terminal device 20 (20') and the in-vehicle transponder and between the terminal device 20 (20') and the rearward server via a communication line such as the Internet or a dedicated communication line.

While some embodiments of the invention have been described above, these embodiments are presented as an example and are not intended to limit the scope of the invention. These embodiments can be modified in various other forms and can be subjected to various omissions, substitutions, and modifications without departing from the gist of the invention. The embodiments and the modifications thereof belong to the scope or gist of the invention and also similarly belong to the configurations described in the appended claims and a scope equivalent thereto.

INDUSTRIAL APPLICABILITY

According to the aforementioned aspects, it is possible to determine whether a vehicle is traveling in reverse.

REFERENCE SIGNS LIST

1 Determination system
1' Determination system
2 Vehicle
3 Service system management server (rearward server)
4 Payment account management server
5 Satellite
10 In-vehicle transponder
10' In-vehicle transponder
20 Terminal device
20' Terminal device
51 CPU
510 Memory
520 Storage/reproduction device
530 IO I/F
540 Communication I/F

101 Storage unit
102 Transmission processing unit
103 Charge determining information storage unit
104 Charge determining information transmission processing unit
105 Vehicle information managing unit
106 Map information storage unit
107 Candidate determining unit
108 Candidate transmitting unit
110 Radio wave receiving interface
120 Communication interface
201 Receiving unit
202 Charge determining information acquiring unit
203 Charge determining unit
204 Charging information transmission processing unit
205 Setting information storage unit
206 Candidate acquiring unit
207 Candidate transmitting unit
208 Determination receiving unit
209 Alarm unit
210 First communication interface
220 Second communication interface
305 Candidate receiving unit
306 Reverse traveling determining unit
307 Determination transmitting unit
N Communication network
U User

The invention claimed is:

1. A terminal device comprising:

a candidate acquiring unit configured to acquire reverse traveling candidate information including positional information and traveling direction information of a vehicle when a candidate determining unit configured to determine whether there is a likelihood that the vehicle is traveling in reverse determines that there is a likelihood that the vehicle is traveling in reverse; and a candidate transmitting unit configured to transmit the reverse traveling candidate information to a rearward server configured to determine whether the vehicle is traveling in reverse by determining that the vehicle is traveling in reverse when the positional information and the traveling direction information are within a prescribed range.

2. The terminal device according to claim 1, wherein the candidate acquiring unit is configured to acquire the reverse traveling candidate information from an in-vehicle transponder of the vehicle.

3. The terminal device according to claim 1, further comprising:

a determination receiving unit configured to receive reverse traveling determination information indicating that the vehicle is traveling in reverse from the rearward server; and an alarm unit configured to output an alarm when the reverse traveling determination information is received.

4. A rearward server comprising:

a candidate receiving unit configured to receive reverse traveling candidate information including positional information and traveling direction information of a vehicle from a terminal device when a candidate determining unit configured to determine whether there is a likelihood that the vehicle is traveling in reverse determines that there is a likelihood that the vehicle is traveling in reverse;

a reverse traveling determining unit configured to determine whether the vehicle is traveling in reverse by determining that the vehicle is traveling in reverse when the positional information and the traveling direction information are within a prescribed range; and a determination transmitting unit configured to transmit reverse traveling determination information indicating that the vehicle is traveling in reverse when a determination that the vehicle is traveling in reverse is performed.

5. A determination system comprising:

a candidate determining unit configured to determine whether there is a likelihood that a vehicle is traveling in reverse;

a candidate transmitting unit configured to transmit reverse traveling candidate information including positional information and traveling direction information of the vehicle when the candidate determining unit determines that there is a likelihood that the vehicle is traveling in reverse;

a reverse traveling determining unit configured to determine whether the vehicle is traveling in reverse by determining that the vehicle is traveling in reverse when the positional information and the traveling direction information are within a prescribed range; and a determination transmitting unit configured to transmit reverse traveling determination information indicating that the vehicle is traveling in reverse when a determination that the vehicle is traveling in reverse is performed.

6. The terminal device according to claim 1, wherein an area in a vicinity of an interchange or an area in a vicinity of a parking lot is defined as the prescribed range for the positional information.

7. The terminal device according to claim 1, wherein a range centering on a direction opposite to a traveling direction of a lane related to the positional information is defined as the prescribed range for the traveling direction information.

8. The rearward server according to claim 4, wherein an area in a vicinity of an interchange or an area in a vicinity of a parking lot is defined as the prescribed range for the positional information.

9. The rearward server according to claim 4, wherein a range centering on a direction opposite to a traveling direction of a lane related to the positional information is defined as the prescribed range for the traveling direction information.

10. The determination system according to claim 5, wherein an area in a vicinity of an interchange or an area in a vicinity of a parking lot is defined as the prescribed range for the positional information.

11. The determination system according to claim 5, wherein a range centering on a direction opposite to a traveling direction of a lane related to the positional information is defined as the prescribed range for the traveling direction information.

* * * * *